US011255048B2

(12) United States Patent
Toles et al.

(10) Patent No.: US 11,255,048 B2
(45) Date of Patent: Feb. 22, 2022

(54) SIZING COMPOSITIONS

(71) Applicant: Hewlett-Packard Development Company, L.P., Fort Collins, CO (US)

(72) Inventors: Christopher Arend Toles, San Diego, CA (US); Thomas Roger Oswald, Boise, ID (US); Bor-Jiunn Niu, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 147 days.

(21) Appl. No.: 15/742,103

(22) PCT Filed: Oct. 2, 2015

(86) PCT No.: PCT/US2015/053698
§ 371 (c)(1),
(2) Date: Jan. 5, 2018

(87) PCT Pub. No.: WO2017/058246
PCT Pub. Date: Apr. 6, 2017

(65) Prior Publication Data
US 2018/0202107 A1 Jul. 19, 2018

(51) Int. Cl.
*D21H 21/16* (2006.01)
*D21H 17/28* (2006.01)
(Continued)

(52) U.S. Cl.
CPC ..... *D21H 21/16* (2013.01); *D21H 17/28* (2013.01); *D21H 17/36* (2013.01); *D21H 17/66* (2013.01);
(Continued)

(58) Field of Classification Search
CPC ..... D21H 21/16
See application file for complete search history.

(56) References Cited

U.S. PATENT DOCUMENTS 6,207,258 B1 * 3/2001 Varnell ..... B41M 5/0017 428/32.1
6,576,049 B1 * 6/2003 Dilts ..... D21H 21/16 106/219
(Continued)

FOREIGN PATENT DOCUMENTS

CN 1769065 5/2006
CN 1871317 11/2006
(Continued)

OTHER PUBLICATIONS

International Search Report dated Jun. 21, 2016 for PCT/US2015/053698, Applicant Hewlett-Packard Development Company, L.P.

*Primary Examiner* — Liam J Heincer
(74) *Attorney, Agent, or Firm* — Thorpe North & Western LLP

(57) ABSTRACT

The present disclosure is drawn to sizing compositions, which can include 25 wt % to 80 wt % starch based on dry components, 15 wt % to 60 wt % cationic multivalent salt based on dry components, and an organic additive. The organic additive can be a water-swellable polymer having a weight average molecular weight ranging from 150,000 Mw to 1,000,000 Mw, a wax, or both the water-swellable polymer and the wax.

10 Claims, 2 Drawing Sheets

(51) Int. Cl.

| | |
|---|---|
| ***D21H 17/36*** | (2006.01) |
| ***D21H 17/66*** | (2006.01) |
| ***D21H 19/54*** | (2006.01) |
| ***D21H 19/84*** | (2006.01) |
| ***D21H 21/30*** | (2006.01) |
| ***D21H 19/18*** | (2006.01) |
| ***D21H 19/60*** | (2006.01) |
| ***D21H 17/60*** | (2006.01) |

(52) U.S. Cl.
CPC ..... *D21H 19/18* (2013.01); *D21H 19/54* (2013.01); *D21H 19/60* (2013.01); *D21H 19/84* (2013.01); *D21H 21/30* (2013.01); *D21H 17/60* (2013.01)

(56) References Cited

U.S. PATENT DOCUMENTS

| | | | | |
|---|---|---|---|---|
| 7,682,438 | B2 * | 3/2010 | Song | B41M 5/0035 106/214.1 |
| 8,132,907 | B2 | 3/2012 | Kariya et al. | |
| 8,425,728 | B2 | 4/2013 | Zhou et al. | |
| 8,480,225 | B2 | 7/2013 | Romano et al. | |
| 8,652,594 | B2 | 2/2014 | Koenig et al. | |
| 8,685,503 | B2 | 4/2014 | Zhou et al. | |
| 8,846,798 | B2 * | 9/2014 | Fu | B41J 11/002 524/487 |
| 2001/0003778 | A1 | 6/2001 | Furunaga et al. | |
| 2002/0015854 | A1 * | 2/2002 | Billmers | D21H 19/12 428/500 |
| 2008/0124499 | A1 | 5/2008 | Sundvall et al. | |
| 2009/0274855 | A1 * | 11/2009 | Koenig | B41M 5/0035 428/32.21 |
| 2009/0317549 | A1 * | 12/2009 | Tan | D21H 21/16 427/288 |
| 2010/0086709 | A1 * | 4/2010 | Huang | D21H 21/16 428/32.18 |
| 2010/0129553 | A1 * | 5/2010 | Jackson | B41M 5/52 427/288 |
| 2010/0181536 | A1 * | 7/2010 | Gauto | C08K 5/0041 252/301.23 |
| 2010/0196601 | A1 | 8/2010 | Goto et al. | |
| 2011/0146929 | A1 * | 6/2011 | Jackson | D21H 17/63 162/172 |
| 2011/0205287 | A1 * | 8/2011 | Zhou | B41M 5/5218 347/20 |
| 2011/0226993 | A1 * | 9/2011 | Jackson | B41M 5/5227 252/301.25 |
| 2011/0240242 | A1 * | 10/2011 | Koenig | C09D 103/06 162/175 |
| 2012/0236095 | A1 * | 9/2012 | Pal | C09D 133/08 347/102 |
| 2012/0311798 | A1 * | 12/2012 | Klein | D21H 21/30 8/636 |
| 2013/0235118 | A1 * | 9/2013 | Zhou | B41M 5/52 347/20 |
| 2014/0220323 | A1 * | 8/2014 | Koenig | D21H 17/28 428/211.1 |
| 2014/0356555 | A1 * | 12/2014 | Toles | B41M 5/5218 428/32.38 |
| 2015/0132509 | A1 * | 5/2015 | Wang | B41M 5/506 428/32.19 |
| 2015/0352877 | A1 * | 12/2015 | Niu | B41M 5/0017 428/32.34 |
| 2018/0195237 | A1 * | 7/2018 | Toles | D21H 17/28 |
| 2019/0177920 | A1 * | 6/2019 | Koenig | D21H 21/16 |

FOREIGN PATENT DOCUMENTS

| | | |
|---|---|---|
| CN | 101959694 | 1/2011 |
| CN | 102076505 | 5/2011 |
| CN | 102186678 | 9/2011 |
| CN | 102224294 | 10/2011 |
| CN | 104245339 | 12/2014 |
| CN | 104955656 | 9/2015 |
| EP | 0420637 | 4/1991 |
| WO | 2009110910 | 9/2009 |
| WO | 2011014199 | 2/2011 |
| WO | 2014120175 | 8/2014 |
| WO | 2014146798 | 9/2014 |
| WO | 2015116095 | 8/2015 |

* cited by examiner

SIZING COMPOSITIONS

BACKGROUND

There are several reasons that inkjet printing has become a popular way of recording images on various media surfaces, particularly paper. Some of these reasons include low printer noise, variable content recording, capability of high speed recording, and multi-color recording. Additionally, these advantages can be obtained at a relatively low price to consumers. Though there has been great improvement in inkjet printing, accompanying this improvement are increased demands by consumers in this area, e.g., higher speeds, higher resolution, full color image formation, increased stability, etc. Additionally, inkjet printing is becoming more prevalent in high speed commercial printing markets, competing with more laborious offset and gravure printing technologies. Coated media typically used for these more conventional types of printing, e.g., offset or gravure printing, can perform somewhat acceptably on high speed inkjet printing devices, but these types of media are not always acceptable for inkjet technology as it relates to image quality, gloss, abrasion resistance, and other similar properties.

BRIEF DESCRIPTION OF THE DRAWINGS

Additional features and advantages of the disclosure will be apparent from the detailed description which follows, taken in conjunction with the accompanying drawings, which together illustrate, by way of example, features of the present technology.

Figure 1:
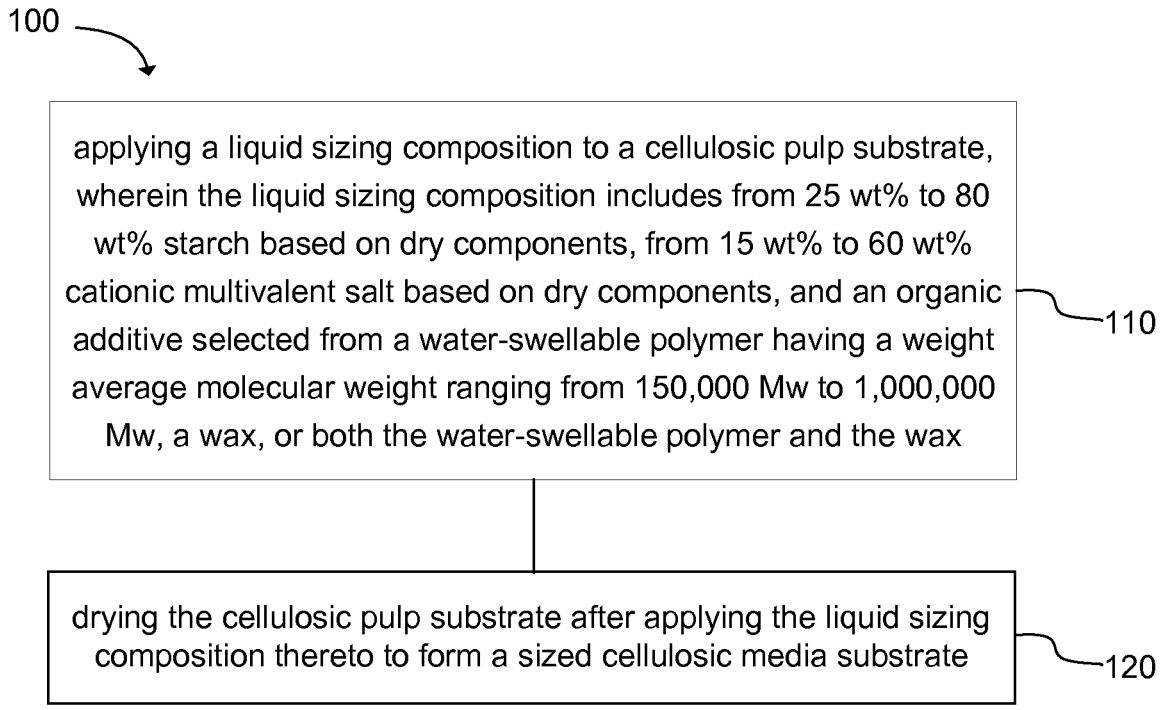
FIG. 1 is a flow chart of a method of sizing a media substrate in accordance with an example of the present technology.

Reference will now be made to several examples that are illustrated herein, and specific language will be used herein to describe the same. It will nevertheless be understood that no limitation of the scope of the disclosure is thereby intended.

DETAILED DESCRIPTION

The present disclosure is drawn to sizing compositions. In some examples, the sizing compositions can be ink-receiving sizing compositions, in that the sizing compositions can be used to form surfaces on print media for receiving inks such as inkjet inks. The sizing compositions can be applied to a cellulosic media pulp or substrate to form an ink-receiving composition absorbed in the substrate, which is receptive for receiving inkjet ink with rapid smearfastness. In other words, these types of sizing compositions are particularly useful to decrease ink smear and roller tracking, especially on duplex documents, in a high speed printing environment, e.g., due to contact of printed inks with mechanical features typically present on duplex printers. Additionally, obtaining fast dry time and smudge resistance while maintaining print density and acceptable color gamut can be a challenge because as print density goes up, typically dry times are longer. The sizing compositions of the present technology can help in addressing various combinations of difficulties, even with duplex printing using page-wide array printers.

In accordance with this, in one example, the present technology is drawn to a sizing composition including (by dry weight) from 25 wt % to 80 wt % starch, from 15 wt % to 60 wt % cationic multivalent salt, and an organic additive. The organic additive can be selected from a water-swellable polymer having a weight average molecular weight ranging from 150,000 Mw to 1,000,000 Mw, a wax, or both the water-swellable polymer and the wax. In one example, the sizing composition can include an optical brightener, such as a hexasulfonated or tetrasulfonated optical brightener.

In another example, the present technology is drawn to a method of sizing a cellulosic media substrate. Steps can include applying a sizing composition to a cellulosic pulp substrate, and drying the cellulosic pulp substrate after applying the sizing composition thereto to form the cellulosic media substrate. The sizing composition can include, by dry weight, from 25 wt % to 80 wt % starch, from 15 wt % to 60 wt % cationic multivalent salt, and an organic additive. The organic additive can be selected from a water-swellable polymer having a weight average molecular weight ranging from 150,000 Mw to 1,000,000 Mw, a wax, or both the water-swellable polymer and the wax. In one example, the sizing composition can include an optical brightener, such as a hexasulfonated or tetrasulfonated optical brightener.

In another example, a sized media substrate can include a cellulosic media substrate and a sizing composition applied into a surface of the cellulosic media substrate. The sizing composition can include, by dry components, from 25 wt % to 80 wt % starch, from 15 wt % to 60 wt % cationic multivalent salt, an optical brightener, and an organic additive. The organic additive can be selected from a water-swellable polymer having a weight average molecular weight ranging from 150,000 Mw to 1,000,000 Mw, a wax, or both the water-swellable polymer and the wax. In this example, the sizing composition can be applied to both sides of the cellulosic media substrate. In one example, the sizing composition can include an optical brightener, such as a hexasulfonated or tetrasulfonated optical brightener.

With specific reference to the organic additive in these examples, the water-swellable polymer can be polyvinyl alcohol. In another example, the wax can be a high density polyethylene (HDPE) wax. In another example, the organic additive can comprise both a polyvinyl alcohol and a high density polyethylene wax. Other organic additives can be substituted for these specific water-swellable polymers and waxes as well.

The sizing compositions described herein can be applied to a cellulosic media substrate to improve the ability of the substrate to receive water-based inks and rapidly dry, while reducing smearing, i.e. improving rapid smearfastness. For example, the sizing compositions can improve the durability of images printed with water-based inks. In one example, the sizing composition can be applied to a cellulosic media substrate during the paper making process, and thus, the sizing composition becomes soaked into a surface of the cellulosic media substrate where it remains more concentrated near the surface of the media substrate compared to an inner (relative to the surface) portion of the substrate. In one example, the cellulosic media substrate can be a non-woven cellulosic material such as that derived from cellulosic pulps (paper). The cellulosic pulps can be either a chemical pulp or a mechanical pulp. The pulps can be further classified as thermomechanical pulp (TMP), chemithermal mechanical pulp (CTMP), bleached chemimechanical pulp (BCTMP), or Kraft pulp, each of which is suitable for use in accordance with the present disclosure.

Regarding the sizing composition per se that is applied to the cellulosic media substrate, as mentioned, this composition can include a starch, a cationic multivalent salt, an optical brightener, and an organic additive, as described herein. With specific reference to the starch, certain examples of suitable starches that can be used include corn starch, tapioca starch, wheat starch, rice starch, sago starch and potato starch. These starch species may be unmodified starch, enzyme modified starch, thermal or thermal-chemical modified starch, or chemical modified starch. Examples of chemical modified starch are converted starches such as acid fluidity starches, oxidized starches, or pyrodextrins; derivatized starches such as hydroxyalkylated starches, cyanoethylated starch, cationic starch ethers, anionic starches, starch esters, starch grafts, or hydrophobic starches. In the sizing composition, the starch can be present at from 25 wt % to 80 wt %, by dry components, in the sizing composition as well as on the media substrate (after drying). The starch can alternatively be present at from 35 wt % to 70 wt %, by dry components.

The cationic salt can be present in the sizing composition or on the cellulosic media substrate at a concentration sufficient to immobilize colorants, e.g., pigment, in the ink to be printed thereon and to yield good image quality. In some examples, the sizing composition can include the cationic salt in an amount from 15 wt % to 60 wt %, 25 wt % to 60 wt %, 30 wt % to 50 wt %, or 15 wt % to 40 wt %.

The cationic salt can include a metal cation. In some examples, the metal cation can be sodium, calcium, copper, nickel, magnesium, zinc, barium, iron, aluminum, chromium, or other metal. The cationic salt can also include an anion. In some examples, the anion can be fluoride, chloride, iodide, bromide, nitrate, chlorate, acetate, or $RCOO^-$ where R is hydrogen or any low molecular weight hydrocarbon chain, e.g., C1 to C12. In a more specific example, the anion can be a carboxylate derived from a saturated aliphatic monocarboxylic acid having 1 to 6 carbon atoms or a carbocyclic monocarboxylic acid having 7 to 11 carbon atoms. Examples of saturated aliphatic monocarboxylic acid having 1 to 6 carbon atoms may include formic acid, acetic acid, propionic acid, butyric acid, isobutyric acid, valeric acid, isovaleric acid, pivalic acid, and/or hexanoic acid. In some cases, the cationic salt can be a polyvalent metal salt made up of a divalent or higher polyvalent metallic ion and an anion. In certain examples, the cationic salt can include calcium chloride, calcium nitrate, magnesium nitrate, magnesium acetate, and/or zinc acetate. In one aspect, the cationic salt can include calcium chloride or calcium nitrate ($CaCl_2$ or $Ca(NO_3)_2$). In one additional specific aspect, the cationic salt can include calcium chloride ($CaCl_2$). The cationic salt can also be a mixture of two or more different cationic salts. In such examples, the total amount of the mixture of cationic salts can be greater than 15 wt % of all dry components of the sizing composition, or any of the other amounts of cationic salt disclosed herein. In other words, whatever range is considered, it is understood that the range relates to total concentrations of salts, whether there be one, two, three, etc., specific salt species present.

In further detail, the sizing composition can include an organic additive, such as a water-swellable polymer, or a wax, or both. The organic additive (in total) can be present at from 0.1 wt % to 15 wt %, from 1 wt % to 10 wt %, from 2 wt % to 9 wt %, or from 3 wt % to 8 wt %, for example. When both the water-swellable polymer and the wax are present, these components can be present at a weight ratio ranging from 1:10 to 10:1, from 1:5 to 5:1, or from 1:2 to 2:1, for example.

With specific reference to the water-swellable polymer, such polymers can have a relatively high molecular weight, e.g., from 150,000 Mw to 1,000,000 Mw, or from 200,000 Mw to 700,000 Mw, or from 200,000 Mw to 500,000 Mw, or from 300,000 Mw to 700,000 Mw; and can these polymers can interact favorably with water-based inks. In one example, the water-swellable polymer can be a polyvinyl alcohol (including any degree of hydrolysis), cellulose, polyethylene oxide, or polyvinyl pyrrolidone (PVP). That being stated, polyvinyl alcohols tend to perform more favorably than other types of swellable polymers because they tend to contribute more so to improved rapid smearfastness. Poor smearfastness immediately after printing can be problematic because the printed image can be easily smeared if the image is rubbed or otherwise disturbed soon after printing. For example, when using an HP high speed Web Press®, the printing is a continuous process and the paper is rewound as a roll after printing. The image or text printed on the paper can be smeared when the paper is rewound if the dry durability is poor. Likewise, when using a high speed duplex printer, such as an HP OfficeJet® Pro X printer, rollers and other mechanical printer features can disturb ink that has been very recently printed. Prior solutions to this problem have included reducing the printing speed, increasing drying temperature, or increasing drying zones. Several disadvantages are associated with these solutions, such as, increasing the drying time leads to reducing the production rate, which increases the cost or time cost of printing. Furthermore, harsher drying conditions can cause increased paper cockle. Increasing the size of the drying zone makes the printing system occupy a larger space, which increases the total cost or space cost of printing. Furthermore, some printers do not utilize driers, so print quality can also benefit from increased rapid smearfastness under ambient conditions.

The type of water-swellable polymer is not particularly limited, but as mentioned, on one example, the polymer can be a polyvinyl alcohol without any particular limitation on the degree of hydrolysis. However, in some examples, the polyvinyl alcohol can have a degree of hydrolysis from about 78 mol % to about 100 mol %. In certain examples, the degree of hydrolysis can be from about 86 mol % to about 100 mol %. The hydroxyl groups on the polyvinyl alcohol may interact with the cationic salt in the sizing composition to form a complex-like structure, which may improve the rapid smearfastness of printed images on a sized media substrate. Alternatively, the water-swellable polymer, such as with polyvinyl alcohol, may absorb water from the ink vehicle allowing the ink film to form quicker and more durably.

A non-limiting examples of polyvinyl alcohol that can be used in the sizing composition includes Poval® 40-88 (Kuraray America, Inc.) (205,000 Mw, 86.7-88.7 mol % hydrolysis); Mowiol 40-88 (205,000 Mw, 88 mol % hydrolysis); or the like.

In some cases, the sizing composition can include a secondary water soluble polymeric binder. Non-limiting examples of such binders include cellulose, polyethylene oxide, polyvinyl pyrrolidone, or others. The secondary binder can also be a mixture of two or more such water soluble polymeric binders. In some examples, if the secondary polymer is present, then it can be present in a smaller amount than the first water-swellable polymer, e.g., polyvinyl alcohol and polyvinyl pyrrolidone, or any other mixture. For example, the polyvinyl alcohol may make up at least 50 wt % by dry weight of all water-swellable polymer present in the sizing composition. In still further examples, the polyvinyl alcohol can make up at least 80 wt % by dry weight of all water-swellable polymer present in the sizing composition. In a specific example, the sizing composition can be substantially free of or free of any water soluble polymeric binder other than polyvinyl alcohol. In some examples, a water-swellable polymer can be present in the sizing composition at an amount of 0.1 wt % to 15 wt % of all dry ingredients in the sizing composition. In other examples, the water-swellable polymer can be present in an amount of 1 wt % to 10 wt % of all dry ingredients in the sizing composition.

In further detail, the organic additive can alternatively be a wax, or a combination of the water-swellable polymer and the wax. Suitable waxes can include particles of a synthetic wax, natural wax, combinations of a synthetic wax and a natural wax, combinations of two or more different synthetic waxes, or combinations of two or more different natural waxes, for example. In some examples, the synthetic wax can include polyethylene, polypropylene, polybutadiene, polytetrafluoroethylene, polyvinylfluoride, polyvinyldiene fluoride, polychlorotrifluoroethylene, perfluoroalkoxy polymer, perfluoropolyether, polyurethane, polyethylenechlorotrifluoroethylene, polyethylene-vinyl acetate, epoxy resin, silicone resin, polyamide resin, polyamide, or polyester resin. In some examples, the natural wax can include carnauba wax, paraffin wax, montan wax, candelilla wax, ouricury wax, sufarcane wax, retamo wax, or beeswax. In one example, the wax can be a polyethylene wax, such as a high density polyethylene (HDPE) wax. Commercially available waxes that can be used include Michemshield® 29235 (Michelman, Inc.), Ultralube® E846 (Keim-Additec Surface GmbH), and Ultralube® D-806 (Keim-Additec Surface GmbH), for example. In some examples, a wax can be present in the sizing composition at an amount of 0.1 wt % to 15 wt % of all dry ingredients in the sizing composition. In other examples, the wax can be present in an amount of 1 wt % to 10 wt % of all dry ingredients in the sizing composition. In one specific example, the wax can be a non-ionic HDPE (high density polyethylene) wax particulate.

In addition to the starch, cationic salt, and organic additive, the sizing composition can also include an optical brightener (OBA). With these optical brighteners, paper brightness and/or whiteness of a properly sized recording medium or print media can be modified as desired. As such, optical brightening agents (OBAs), which include fluorescent whitening agents (FWA), can be added to improve the optical appearance of the paper like brightness or whiteness. OBAs are generally compounds that absorb ultraviolet radiant energy at 300-360 nm of the electromagnetic spectrum, and re-emit energy in the visible range mainly in the blue wavelength region (typically 420-470 nm). In one specific example, the optical brighter can be a hexasulfonated optical brightener or a tetrasulfonated optical brightener. The optical brightener can be present at, by dry weight, from 2 wt % to 30 wt %, from 5 wt % to 25 wt %, or from 10 wt % to 20 wt %.

The sizing composition can also include other additives such as surfactants, rheology modifiers, defoamers, biocides, pH controlling agents, dyes, and other additives for further enhancing the properties of the sizing composition. The total amount of such optional additives can be present, individually if present, in the range of 0.01 wt % to 5 wt % of all dry ingredients of the sizing composition. That being said, in some examples, the composition does not include additional additives of significance, and thus, the sizing composition can consist essentially of (or consist of) the starch, the cationic multivalent salt, the optical brightener, and the water-swellable polymer. In another example, the sizing composition can consist essentially of (or consist of) the starch, the cationic multivalent salt, the optical brightener, and the wax. In another example, the sizing composition can consist essentially of (or consist of) the starch, the cationic multivalent salt, the optical brightener, the water-swellable polymer, and the wax.

The present technology also extends to methods of sizing a media substrate. FIG. 1 is a flowchart of exemplary method of sizing a media substrate 100. The method includes applying 110 a liquid sizing composition to a cellulosic pulp substrate, and drying 120 the cellulosic pulp substrate after applying the liquid sizing composition thereto to form a sized cellulosic media substrate. The sizing composition can include (based on dry components) from 25 wt % to 80 wt % starch, from 15 wt % to 60 wt % cationic multivalent salt, and an organic additive. The organic additive can be selected from a water-swellable polymer having a weight average molecular weight ranging from 150,000 Mw to 1,000,000 Mw, a wax, or both the water-swellable polymer and the wax. In some examples, the sizing composition can be applied to the cellulosic media substrate after a preliminary drying step (but before a final drying step). In one example, the sizing composition can be applied to both sides of the cellulosic pulp substrate.

The composition can be applied to the substrate by any of a number of application methods. In accordance with examples of the present disclosure, the substrate can be applied by spraying or otherwise applying during the paper making process using a sizing press. For example, the cellulosic media substrate can be prepared using conventional or other paper making processes, and prior to a final drying step, the sizing composition can be applied. In one example, the sizing composition can be applied after an initial drying step, but prior to a final drying step. Drying steps can be carried out using heated air, forced air, heating lamps, or the like. In further detail, the sized print media can be prepared by application of the sizing composition to a cellulosic pulp substrate (during the paper making process) using any known size press technique, including but not limited to vertical size press, horizontal size press, inclined size press, gate roll size press, flooded nip size press, or metered size press techniques. In one example herein, a "size press" process can be used which refers to a portion of the paper manufacturing process that is located between dryer sections, e.g. a preliminary drying step to dry the cellulosic pulp followed by applying a sizing composition into the cellulosic pulp followed by a subsequent or final drying step to dry the sized media substrate. Other sizing compositions or other coatings can be applied in addition to application of the sizing composition of the present disclosure.

The quantity of sizing composition selected for application to the cellulosic media substrate can vary. In one example, the sizing composition can be applied wet (carried by a solvent carrier), but the sizing compounds present in the composition is based on a dry coat weight ranging from 0.1 gsm to 20 gsm. In another example, the dry coat weight can be from 0.3 gsm to 10 gsm. In another example, the dry coat weight can be from 0.3 gsm to 5 gsm. In another example, the sizing composition can be applied to the substrate at a dry coat weight from 0.3 gsm to 1 gsm.

Once the paper is dry and in condition for printing, in one example, ink can be printed on the sized media substrate. In some cases, the ink can be a water-based ink, such as a water-based inkjet ink, or a pigmented water-based inkjet ink. Inkjet inks generally include a colorant dispersed or dissolved in an ink vehicle. As used herein, "liquid vehicle" or "ink vehicle" refers to the liquid fluid in which a colorant is placed to form an ink. A wide variety of ink vehicles may be used with the systems and methods of the present disclosure. Such ink vehicles may include a mixture of a variety of different agents, including, surfactants, solvents, co-solvents, anti-kogation agents, buffers, biocides, sequestering agents, viscosity modifiers, surface-active agents, water, etc. Though not part of the liquid vehicle per se, in addition to the colorants, the liquid vehicle can carry solid additives such as polymers, latexes, UV curable materials, plasticizers, etc.

Generally the colorant discussed herein can include a pigment and/or dye. As used herein, "dye" refers to compounds or molecules that impart color to an ink vehicle. As such, dye includes molecules and compounds that absorb electromagnetic radiation or certain wavelengths thereof. For example, dyes include those that fluoresce and those that absorb certain wavelengths of visible light. In most instances, dyes are water soluble. Furthermore, as used herein, "pigment" generally includes pigment colorants, magnetic particles, aluminas, silicas, and/or other ceramics, organo-metallics or other opaque particles. In one example, the colorant can be a pigment.

Typical ink vehicle formulations can include water, and can further include co-solvent(s) present in total at from 0.1 wt % to 40 wt %, depending on the jetting architecture, though amounts outside of this range can also be used. Further, additional non-ionic, cationic, and/or anionic surfactants can be present, ranging from 0.01 wt % to 10 wt %. In addition to the colorant, the balance or much of the remaining of formulation components can be purified water and other known liquid additives. Other solids can likewise be present in the inkjet ink, such as latex particles.

Consistent with the formulation of this disclosure, various other additives may be employed to enhance the properties of the ink composition for specific applications. Examples of these additives are those added to inhibit the growth of harmful microorganisms. These additives may be biocides, fungicides, and other microbial agents, which are routinely used in ink formulations. Examples of suitable microbial agents include, but are not limited to, NUOSEPT® (Nudex, Inc.), UCARCIDE™ (Union carbide Corp.), VANCIDE® (R.T. Vanderbilt Co.), PROXEL® (ICI America), ACTICIDE® (Thor Specialties Inc.) and combinations thereof.

Figure 2:
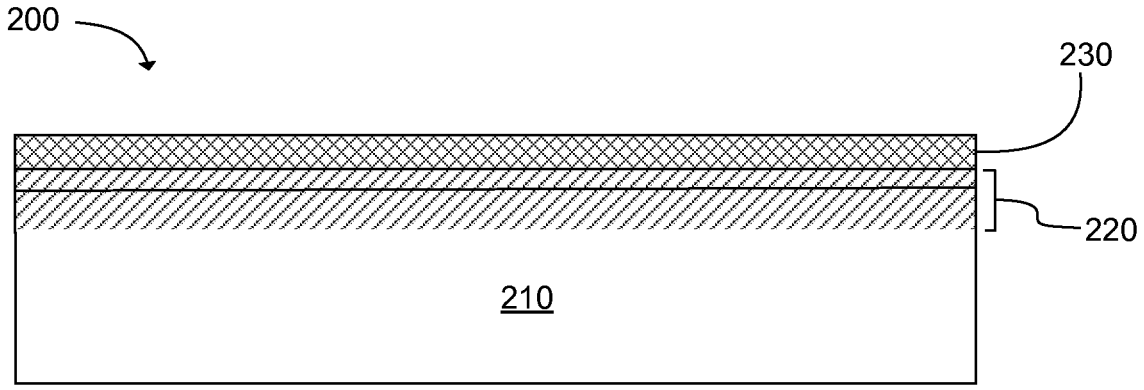
FIG. 2 shows a cross-sectional view of a sized media substrate in accordance with an example of the present technology.

FIG. 2 shows an example of a sized media substrate 200 with an ink printed thereon. Specifically, a cellulosic media substrate 210 can be sized with a sizing composition 220, which typically becomes soaked into the cellulosic media substrate (as shown) during the manufacturing process, but is also typically more concentrated near a surface of the sized media substrate (as shown). To the sized media substrate, an ink jet ink 230 can be printed to form a printed image. The image can have improved rapid smearfastness after printing.

Figure 3:
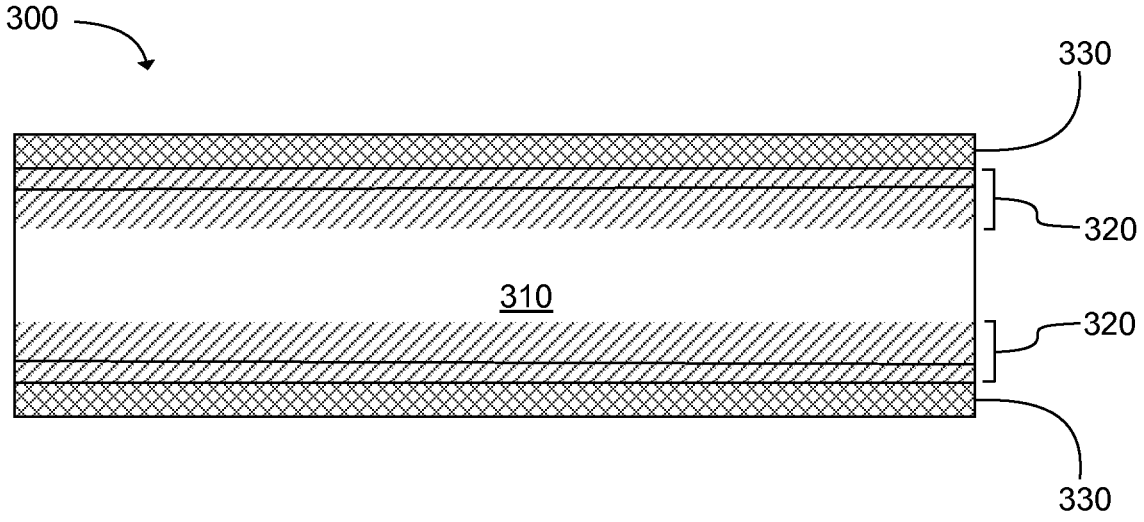
FIG. 3 shows a cross-sectional view of a sized media substrate in accordance with an example of the present technology.

FIG. 3 shows another example of a sized media substrate 300. In this example, the cellulosic media substrate 310 has a sizing composition 320 applied to both sides of the cellulosic media substrate. Ink jet ink 330 is used to print images one or on both sides of the sized media substrate. Thus, the sized media substrate can be used for double sided printing with rapid drying properties with rapid smearfastness capabilities. Although not shown in the figures, the cellulosic media substrate can also include its own coating. Certain coatings (or pre-coatings) described herein can often already be present as part of a substrate, and these coatings are not the same as the sizing composition primarily discussed in the context of the present disclosure. In other words, the sizing compositions of the present disclosure include those which are overcoated with respect to any pre-applied coatings, or alternatively, to cellulosic media substrates that are not already pre-coated. Such coatings, i.e. the pre-coating and/or the sizing compositions of the present disclosure, can be present on either one side of a media substrate or both.

It is noted that, as used in this specification and the appended claims, the singular forms "a," "an," and "the" include plural referents unless the content clearly dictates otherwise.

"Rapid smearfastness" refers to the ability of a printed image to resist smearing when rubbed with an instrument such as a finger or an eraser (which approximates printer rollers that can cause real examples of smudging when in use), immediately after printing or within a short time of being printed. The short time can be, for example, from 1 second to 30 seconds, from 1 second to 20 seconds, or from 5 seconds to 10 seconds. In some cases, the short time can be the time used for a printed image to travel from the inkjet printer to a rewinding roll, or for a printed sized media substrate to be flipped over in a duplex printer.

When referring to "high speed" as it is related to a digital printing press or other high speed printer, e.g., presses such as the HP T230 Web Press® or the HP T350 Web Press®, or presses such as page wide office printers (PWA) including the HP OfficeJet® Pro X duplex printer. In one example, the HP T350 Web Press® can print on media at a rate of 400 feet per minute. This capability would be considered high speed. In another example, and more generally, printing at 100 feet per minute would also be considered high speed. Furthermore, the HP OfficeJet Pro X printer can print at a typical printing speed of 55 to 70 pages/minute, which is also considered to be "high speed."

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

As a further note, in the present disclosure, it is noted that when discussing the sized media substrate, the method of sizing a substrate, or the sizing compositions herein, each of these discussions can be considered applicable to each of these examples, whether or not they are explicitly discussed in the context of that example. Thus, for example, in discussing details about the sizing composition per se, such discussion also refers to the methods and sized media substrates described herein, and vice versa.

The following examples illustrate some of the sizing compositions, sized media substrates, and methods that are presently known. However, it is to be understood that the following are only exemplary or illustrative of the application of the principles of the present compositions, media, and methods. Numerous modifications and alternative compositions, media, and methods may be devised without departing from the spirit and scope of the present disclosure. The appended claims are intended to cover such modifications and arrangements. Thus, while the technology has been described with particularity, the following examples provide further detail in connection with the present technology.

EXAMPLES

Example 1—Formulations and Sized Cellulosic Media Substrates

Formulations 1-5 were prepared in parts by weight based on the formulations shown in Table 1 below. Specifically, Formulation 1 was a control that did not include either of the organic additives, whereas Formulations 2-5 each carried one or both of the organic additives, i.e. water-swellable polymer and/or wax.

TABLE 1

Control Formulation and Example Formulations

| Ingredients based on dry parts by weight | Example No. 1 (Control) | 2 | 3 | 4 | 5 |
|---|---|---|---|---|---|
| Starch (PG270) | 100 | 100 | 100 | 100 | 100 |
| Calcium chloride | 40 | 41 | 42 | 43 | 43 |
| Hexasulfonated optical brightener (Leucophor ® SAC OBA) | 25 | 25 | 26 | 27 | 27 |
| Polyethylene Wax (Ultralube ® D-806) | 0 | 1 | 0 | 0 | 3 |
| Polyvinyl Alcohol (Mowiol ® 40-88; 205,000 Mw; 88% hydrolysis level) | 0 | 0 | 5 | 8 | 5 |

Mowiol ® (from Sigma-Aldrich);
Leucophor ® 105 (from Clariant);
Ultralube ® (from Keim-Additec Surface GmbHO); and
PG270 ® (from from Penford).

The compositions of Formula 1-5 were each used to size a cellulosic media substrate during the paper making process. Specifically, about 1.5 gsm of each composition was used to size each side (both sides) of a cellulosic pulp substrate after an initial or preliminary drying step, but prior to a subsequent or final drying step. More specifically, the resulting cellulosic media substrate was sized identically on both sides in preparation for duplex printing. The resulting sized cellulosic media substrates are referred to hereinafter as Media Sample 1 (Control media prepared from Formulation 1) and Media Samples 2-5 (Example media prepared from Formulations 2-5, respectively).

Example 2—Ink Smear

Figure 4:
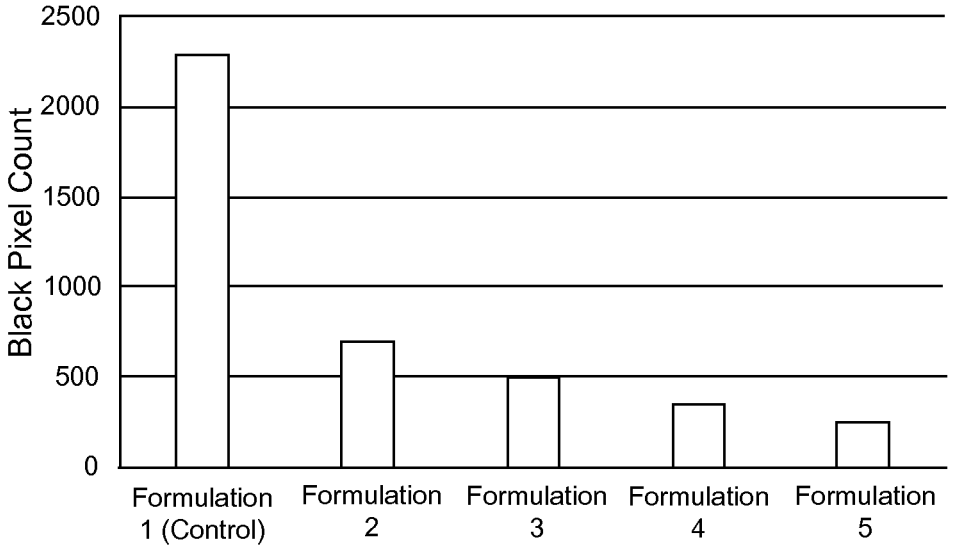
FIG. 4 is a chart which graphically depicts improvements related to smearfastness when the sizing composition includes the organic additive in accordance with examples of the present disclosure.

Media Samples 1-5 were each printed at the top of a single side with a thick black bar (pigment based ink) that was approximately 9 mm×19 mm (i.e. large rectangle at the top of a single side of each page). After printing one side, each Media Sample was flipped over automatically by the printer (HP OfficeJet® Pro X) and the opposite side was printed with minimal characters so that the page would pass through the printer on the second side after flipping to the opposite. This caused the rollers on the back side to run across the high density black rectangle previously printed. The purpose of this was to determine how much ink the rollers on the back side picked up from the rectangle and re-deposited on the white area below black rectangle as the media passed rapidly through the printer. The ink smear was measured by a pixel counting method. Essentially, the greater the number of black pixels that were picked up by the rollers and transferred to a predetermined white area below the black printed rectangle, the less rapid smearfastness that was present. FIG. 4 shows the results of this test. As can be seen, by adding water-swellable polymer and/or wax to the sizing formulations, significant rapid smearfastness improvement was achieved, with the best results occurring with both the water-swellable polymer and wax were included.

While the disclosure has been described with reference to certain examples, various modifications, changes, omissions, and substitutions can be made without departing from the spirit of the disclosure. It is intended, therefore, that the disclosure be limited only by the scope of the following claims.

What is claimed is:

1. A sizing composition, comprising:

25 wt % to 80 wt % starch based on dry components;

15 wt % to 60 wt % cationic multivalent salt based on dry components;

1 wt % to 10 wt % of an organic additive including polyvinyl alcohol having a weight average molecular weight ranging from 150,000 Mw to 1,000,000 Mw and a wax; wherein a weight ratio of the polyvinyl alcohol to the wax is from 1:2 to 2:1; and a hexasulfonated optical brightener.

2. The sizing composition of claim 1, wherein the starch is an unmodified starch, enzyme modified starch, thermal modified starch, thermal-chemical modified starch, chemical modified starch, corn starch, tapioca starch, wheat starch, rice starch, sago starch, potato starch, acid fluidity starch, oxidized starch, pyrodextrin starch, hydroxyalkylated starch, cyanoethylated starch, cationic starch ether, anionic starch, starch ester, starch graft, or hydrophobic starch.

3. The sizing composition of claim 1, wherein the cationic salt comprises a cation of a metal selected from sodium, calcium, copper, nickel, magnesium, zinc, barium, iron, aluminum, or chromium.

4. The sizing composition of claim 1, further including a secondary water soluble polymeric binder selected from cellulose, polyethylene oxide, or polyvinyl pyrrolidone.

5. The sizing composition of claim 1, wherein the wax is a non-ionic high density polyethylene wax.

6. A method of sizing a cellulosic media substrate, comprising:

applying a liquid sizing composition to a cellulosic pulp substrate, wherein the liquid sizing composition, comprises:

25 wt % to 80 wt % starch based on dry components;

15 wt % to 60 wt % cationic multivalent salt based on dry components;

1 wt % to 10 wt % of an organic additive including polyvinyl alcohol having a weight average molecular weight ranging from 150,000 Mw to 1,000,000 Mw and a wax; wherein a weight ratio of the polyvinyl alcohol to the wax is from 1:2 to 2:1; and a hexasulfonated optical brightener; and drying the cellulosic pulp substrate after applying the liquid sizing composition thereto to form a sized cellulosic media substrate.

7. The method of claim 6, wherein the sizing composition is applied to the cellulosic pulp substrate after a preliminary drying step.

8. The method of claim 6, wherein the sizing composition is applied to both sides of the cellulosic pulp substrate.

9. A sized media substrate, comprising:

a cellulosic media substrate; and a sizing composition applied into a surface of the cellulosic media substrate, the sizing composition, comprising:

25 wt % to 80 wt % starch based on dry components, 15 wt % to 60 wt % cationic multivalent salt based on dry components, and 1 wt % to 10 wt % of an organic additive including polyvinyl alcohol having a weight average molecular weight ranging from 150,000 Mw to 1,000,000 Mw and a wax; wherein a weight ratio of the polyvinyl alcohol to the wax is from 1:2 to 2:1; and a hexasulfonated optical brightener.

10. The sized media substrate of claim 9, wherein the sizing composition is applied into both sides of the cellulosic media substrate.

* * * * *